US007002088B2

(12) United States Patent
Shin

(10) Patent No.: US 7,002,088 B2
(45) Date of Patent: Feb. 21, 2006

(54) HANDLE APPARATUS FOR A MANUAL MOTOR

(75) Inventor: Bong-Soo Shin, Cheong ju-si (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/007,310

(22) Filed: Dec. 9, 2004

(65) Prior Publication Data

US 2005/0133352 A1 Jun. 23, 2005

(30) Foreign Application Priority Data

Dec. 19, 2003 (KR) ..... 10-2003-0093800

(51) Int. Cl.
*H01H 3/02* (2006.01)

(52) U.S. Cl. ..... 200/330; 200/400; 200/501; 200/331

(58) Field of Classification Search ..... 200/17 R, 200/400, 401, 500, 501, 330, 331
See application file for complete search history.

(56) References Cited

U.S. PATENT DOCUMENTS 5,288,958 A * 2/1994 Grunert et al. ..... 200/331
6,124,558 A * 9/2000 Baumeister et al. ..... 200/501
6,518,526 B1 * 2/2003 Hamada et al. ..... 200/330
6,566,618 B1 * 5/2003 Hamada et al. ..... 200/331
6,606,229 B1 * 8/2003 Takahashi et al. ..... 200/501

OTHER PUBLICATIONS

U.S. Appl. No. 11/016,911 to Cho, which was filed Dec. 21, 2004.
U.S. Appl. No. 11/016,972 to Shin, which was filed Dec. 21, 2004.

* cited by examiner

*Primary Examiner*—Michael A. Friedhofer
(74) *Attorney, Agent, or Firm*—Greenblum & Bernstein, P.L.C.

(57) ABSTRACT

Disclosed is a handle apparatus of a manual motor starter having an improved structure for transferring driving force between a control lever and a driving lever. The handle apparatus comprises: a rotary handle for controlling ON and OFF operations of the manual motor starter, an interlocking member coaxially coupled with the rotary handle to be rotated by rotation of the rotary handle, the interlocking member having a first gear for providing a driving force; a driving lever having a second gear formed at one side of the driving lever to be rotated by the driving force by the interlocking member, the driving lever having a pin slot for providing a rotational driving force; and a control lever having a sliding pin inserted in the pin slot of the driving lever, through which the rotational driving force is transferred from the driving lever to the control lever.

5 Claims, 8 Drawing Sheets

【FIG. 1】
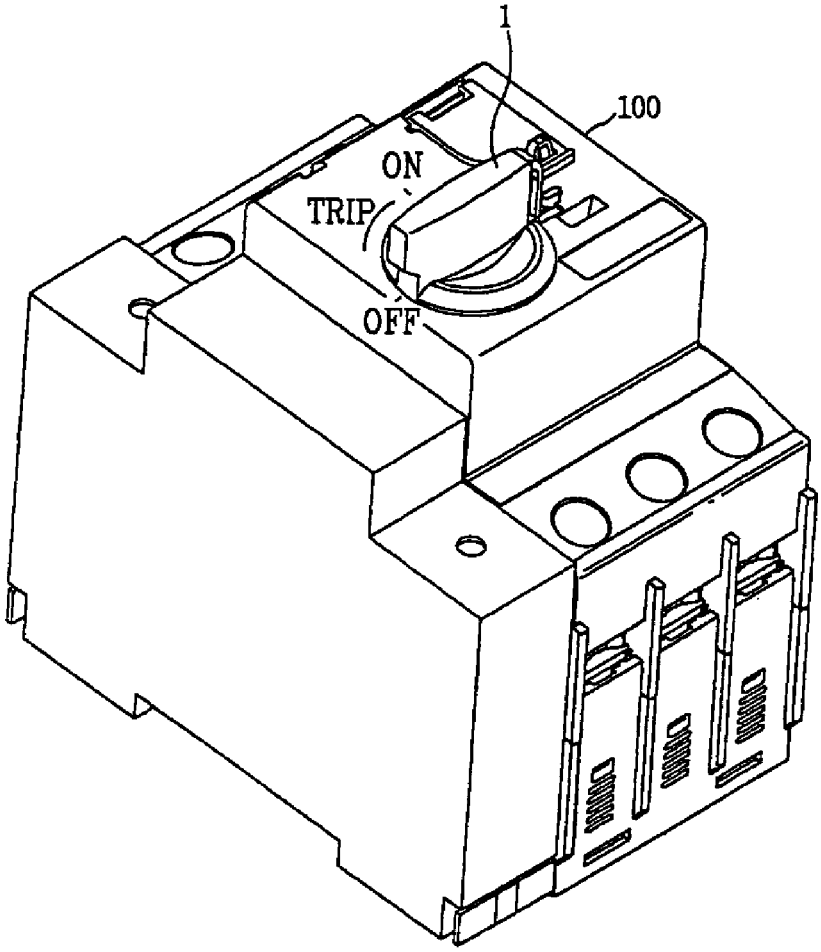
PRIOR ART

【FIG. 2】
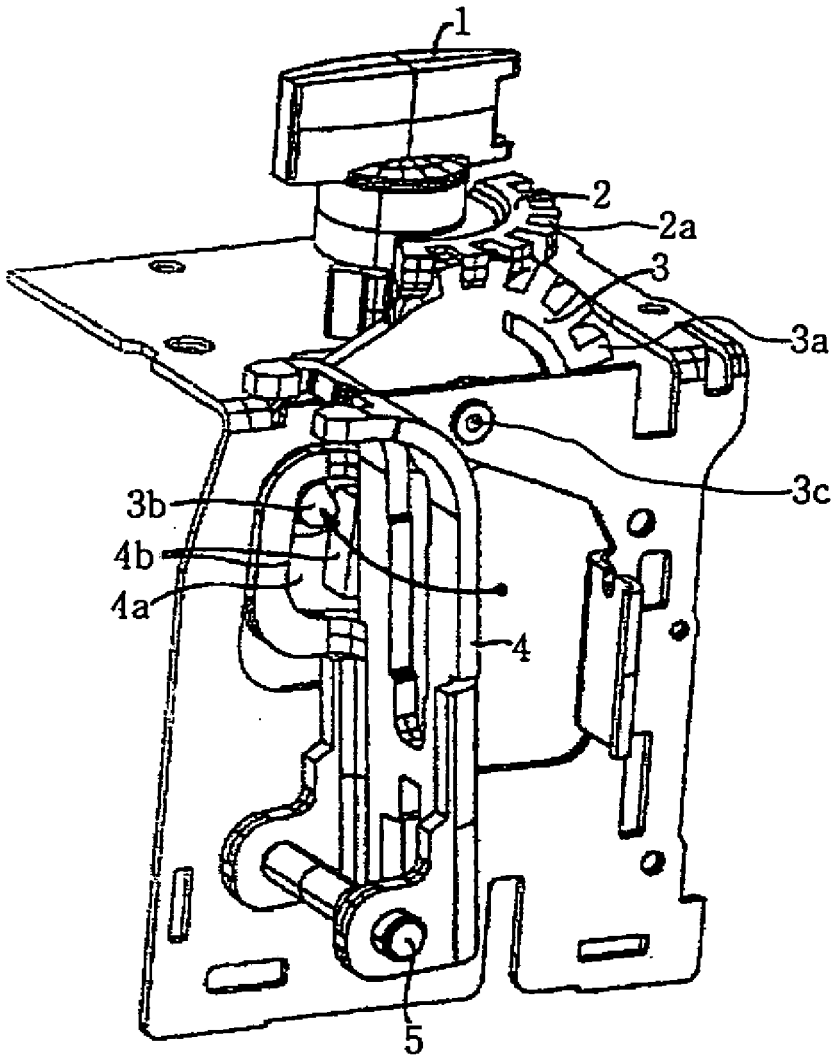
PRIOR ART

【FIG. 3】
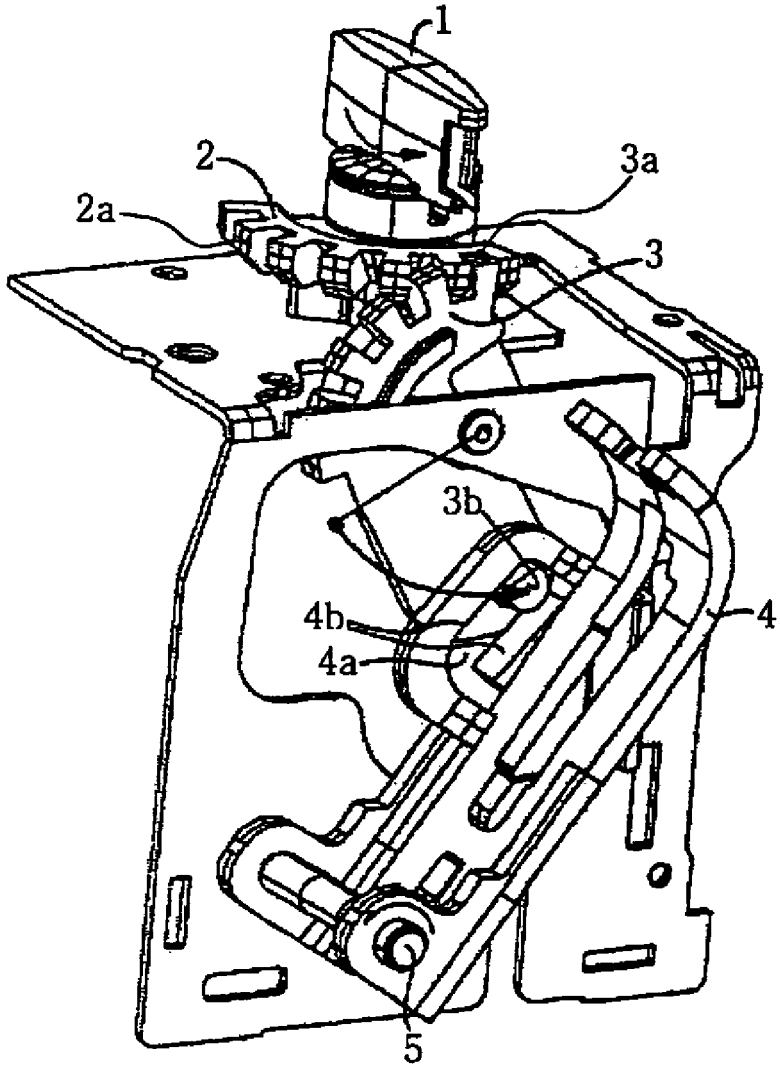
PRIOR ART

【FIG. 4A】
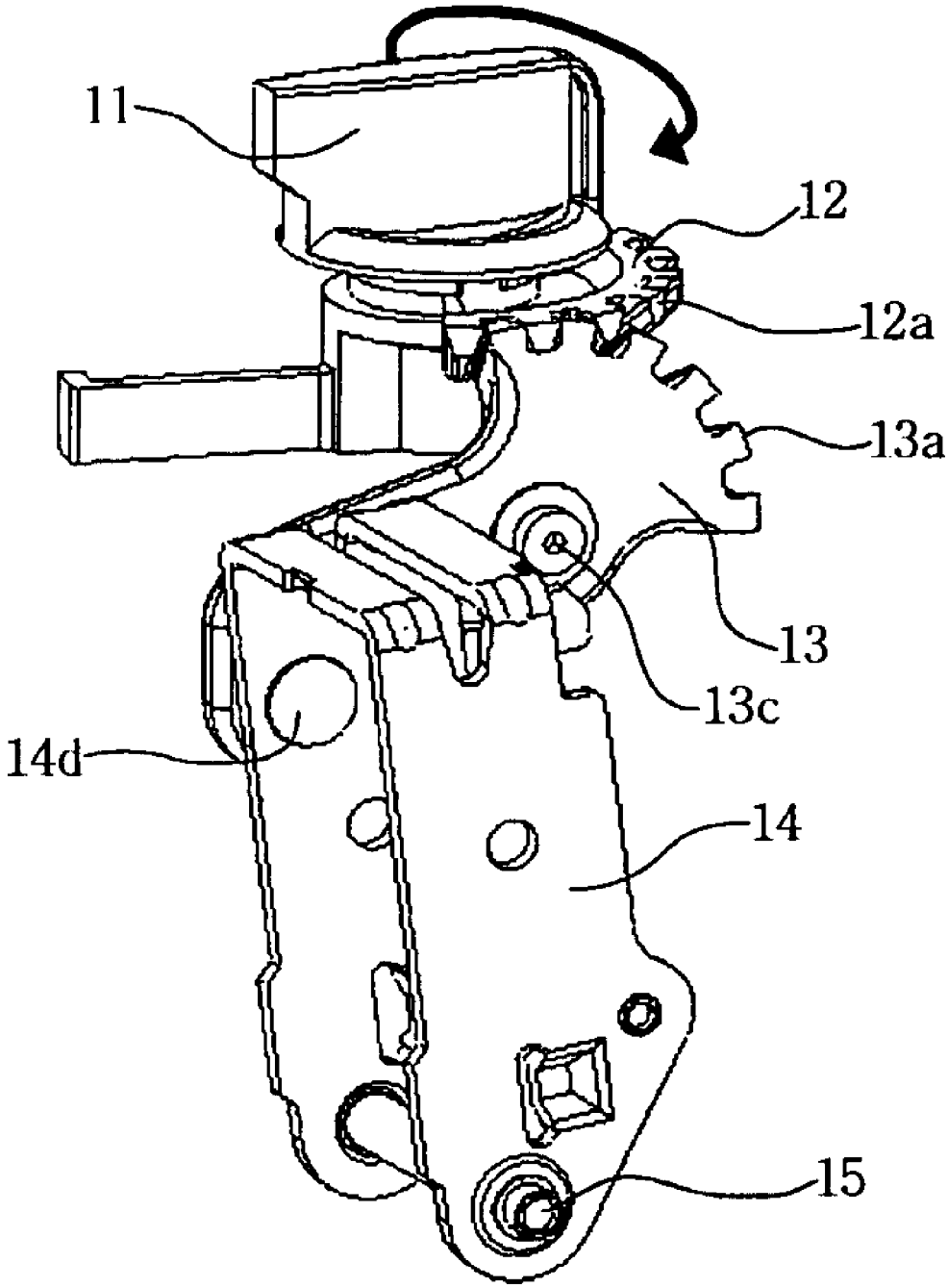

【FIG. 4B】
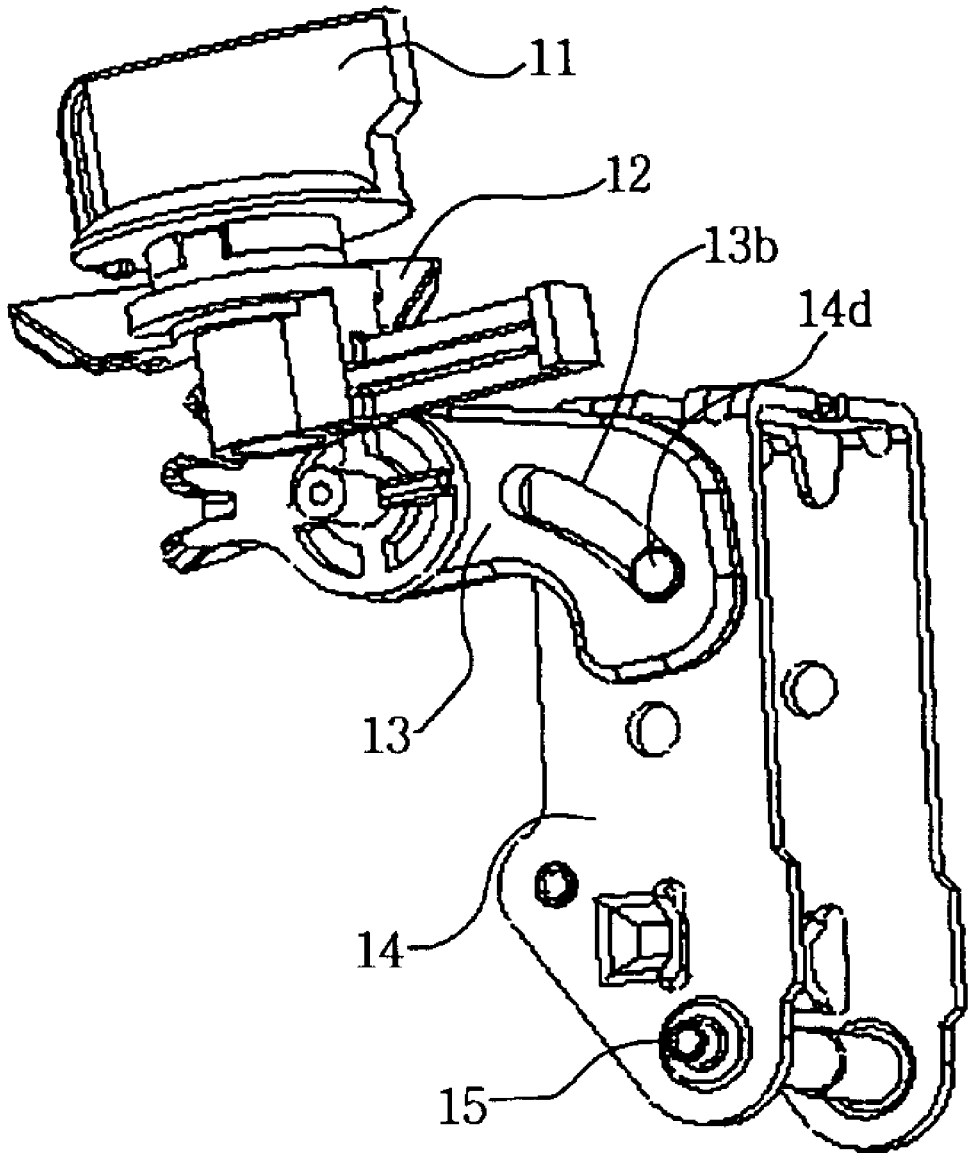

【FIG. 5A】
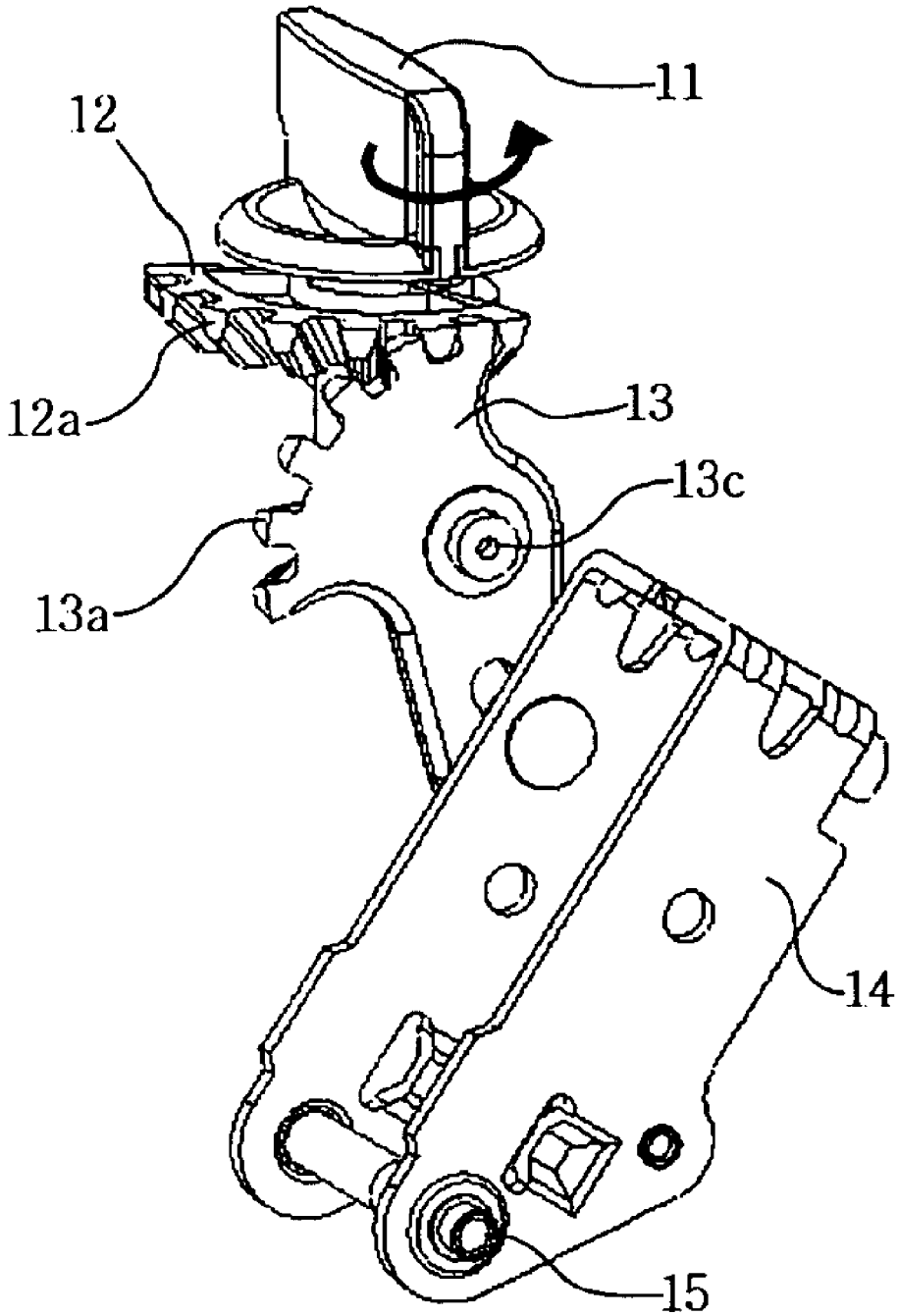

【FIG. 5B】
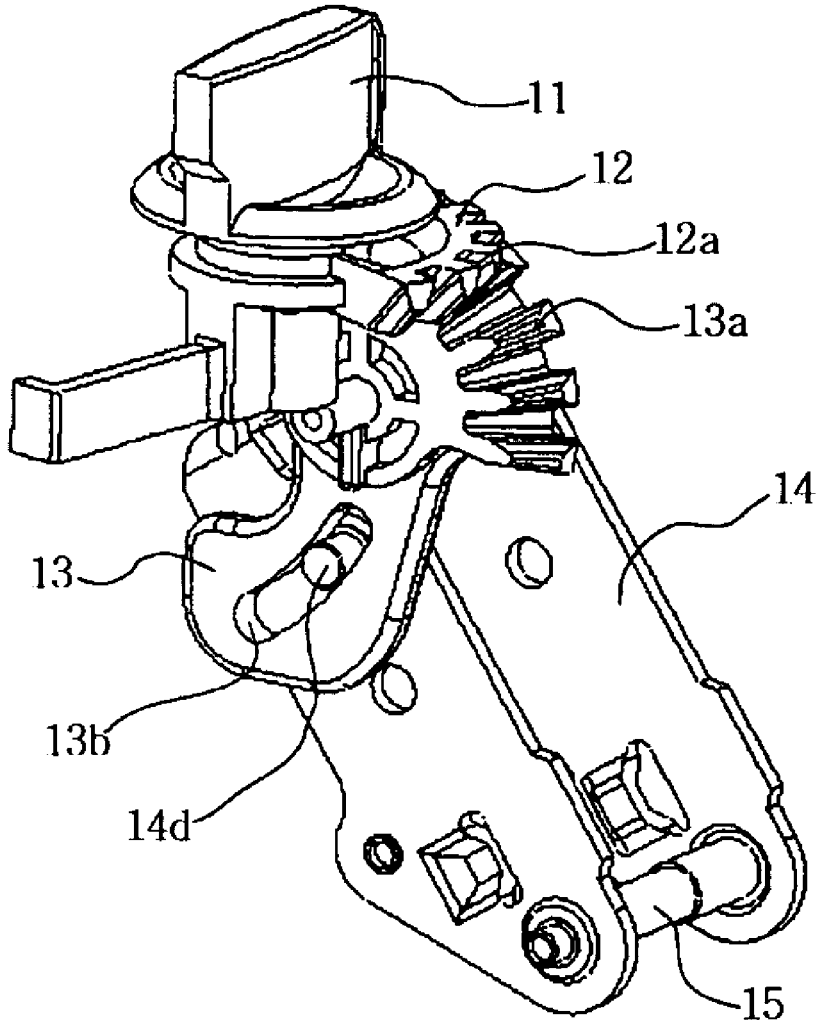

【FIG. 6】
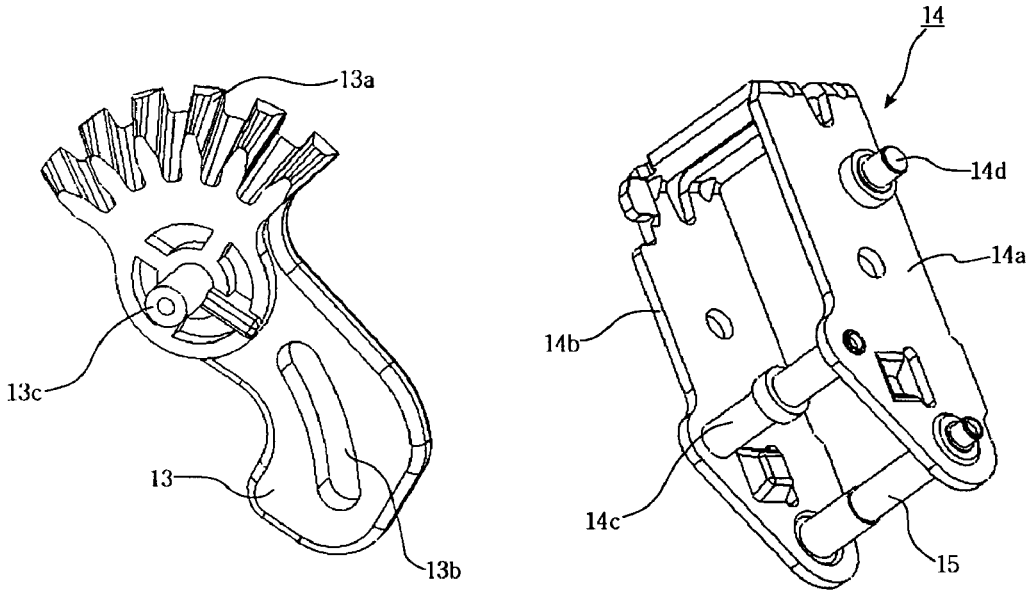

HANDLE APPARATUS FOR A MANUAL MOTOR

BACKGROUND OF THE INVENTION

1. Field of the Invention

The present invention relates to a handle apparatus for a manual motor starter, and more particularly to a handle apparatus of a manual motor starter, which has an improved structure for power transfer between a driving lever and a control lever of the starter, thereby minimizing the wear on parts of the starter and improving both the durability of the starter and the reliability in handle operation of the starter.

2. Description of the Prior Art

As is generally known in the art, a manual motor starter includes a detection part for detecting generation of accidental current, a switching mechanism operated when the generation of accidental current is detected, a contactors operated by the switching mechanism to switch on or off an electric path, an arc extinguishing mechanism for extinguishing and discharging an arc gas which may be generated when contactors are opened and a rotary handle 1 for manually operating the position of the starter to a ON position or OFF position.

FIG. 1 is a perspective view of a conventional manual motor starter for protecting a motor, which includes a manual motor starter body (hereinafter, referred to as "MMS body") 100, a rotary handle 1 provided at the top of the MMS body 100, and an Under Voltage Trip (hereinafter, referred to as "UVT") mechanism provided at one side of the MMS body 100.

When a user rotates the handle 1 to the 'ON' position in order to turn on the manual motor starter for starting a moter, the rotation of the handle 1 moves links of a switching mechanism in the MMS body 100, causing a movable contactor to come into contact with a stationary contactor, so that electrical current flow between the contactors. In contrast, when the user rotates the handle 1 to the 'OFF' position, the links move to separate the contactors from each other, thereby interrupting the flow of electricity. In the manual motor starter having the construction as described above, an apparatus for transferring the rotational displacement of the handle 1 to accessory devices is necessary.

The UVT mechanism is one of various accessory devices of a manual motor starter (hereinafter, referred to as "MMS") from accidents such as short-circuiting or motor overloads. The UVT mechanism trips the switching mechanism in the MMS body 100 when an under voltage below a rated voltage is applied to the MMS.

FIG. 2 is a perspective view of a handle apparatus of a conventional MMS in a state where the MMS is turned off, and FIG. 3 is a perspective view of a handle apparatus of a conventional MMS in a state where the MMS is turned on.

As shown in FIGS. 2 and 3, a handle apparatus of a conventional MMS includes a handle 1 for interrupting turn-on of the MMS, an interlocking assembly 2 connected to the handle 1, a driving lever 3 operated by a driving gear 3*a* engaged with an interlocking gear 2*a* of the interlocking assembly 2, and a control lever 4 rotated about a control lever rotation shaft 5 by the driving lever 3.

The handle 1 can be rotated within an operation range between an "ON" operation and an "OFF" operation. The interlocking assembly 2 is rotated at the same angle as that of the handle 1 according to the rotation of the handle 1. The interlocking assembly 2 has the interlocking gear 2*a* which is engaged with the driving gear 3*a* of the driving lever 3 perpendicularly.

The driving lever 3 is rotated about a driving gear rotation shaft 3*c* according to the rotation of the interlocking assembly 2. Specifically, the driving lever 3 has the driving gear 3*a* formed at one side thereof, which is engaged with the interlocking gear 2*a*, so that the driving lever 3 can be rotated according to rotation of the driving gear 3*a* by the rotation of the interlocking assembly 2. The driving lever 3 also has a protrusion 3*b* formed at the other side of the driving lever 3.

The control lever 4 has a crank hole 4a formed through the control lever 4. The crank hole 4*a* has hole circumferences 4*b* formed at opposite ends of the crank hole 4*a*, through which the protrusion 3*b* of the driving lever 3 is inserted. Therefore, the control lever 4 can be rotated about the control lever rotation shaft 5 within a predetermined angular range by the rotation of the driving lever 3.

According to the rotation of the handle 1, the MMS performs an 'ON' operation for causing the switching mechanism to contact the movable contactor with the stationary contactor, thereby supplying current to a motor, or an 'OFF 'operation for causing the switching mechanism to separate the movable contactor from the stationary contactor, thereby interrupting the supply of current to a motor.

The handle 1 is allowed to rotate within an angular range of 90° for the 'ON' and 'OFF' operations, and the control lever 4 connected to the handle 1 is allowed to rotate within an angular range of 47° for the 'ON' and 'OFF' operations.

In order to guarantee smooth operation of the control lever 4 following the operation of the handle 1, the control lever 4 has the crank hole 4*a* The protrusion 3*b* of the driving lever 3 is guided along the hole circumferences 4*b* of the crank hole 4*a* while preventing play of the control lever 4 in an unexpected direction, thereby achieving a smooth rotation of the control lever 4.

When the handle 1 of the MMS is at the OFF position as shown in FIG. 2, the protrusion 3*b* of the driving lever 3 is located at the upper end of the crank hole 4*a* of the control lever 4. While the handle 1 of the MMS is rotated to the ON position as shown in FIG. 3, the protrusion 3*b* of the driving lever 3 moves downward along the hole circumference 4*b* of the crank hole 4*a* and returns to its original position along the hole circumference 4*b* of the crank hole 4*a*.

However, in the handle apparatus of the conventional MMS having the construction as described above, the protrusion 3*b* of the driving lever 3 made from synthetic resin is incontinuous contact with the hole circumferences 4*b* of the crank hole 4*a* of the control lever 4 made from metal while being moved by the rotation of the handle 1. Therefore, the protuberance 3*b* of the driving lever 3 made from synthetic resin may be easily worn out Further, this problem (wearing of the protuberance 3*b* of the driving lever 3 made from synthetic resin) may become more severe when the handle 1 is operated by an increased driving power or at a higher speed.

SUMMARY OF THE INVENTION

Accordingly, the present invention has been made to solve the above-mentioned problems occurring in the prior art, and an object of the present invention is to provide a handle apparatus for a manual motor starter, in which driving force is transferred by a sliding pin of a control lever made from metal, which is inserted through the pin slot formed through the driving lever made from synthetic resin, thereby solving the problem of the conventional MMS, in which the protrusion of the driving lever made from synthetic resin experience abrasion by circumferential surfaces of the crank hole of the control lever made from metal.

In order to accomplish this object, there is provided a handle apparatus for a manual motor starter, the handle apparatus comprising: a rotary handle for controlling ON and OFF operations of the manual motor starter, an interlocking member coaxially coupled with the rotary handle to be rotated by rotation of the rotary handle, the interlocking member having a first gear for providing a driving force; a driving lever having a second gear formed at one side of the driving lever to be rotated by the driving force by the interlocling member, the driving lever having a pin slot for providing a rotational driving force; and a control lever having a sliding pin inserted in the pin slot of the driving lever, through which the rotational driving force is transferred from the driving lever to the control lever.

BRIEF DESCRIPTION OF THE DRAWINGS

The above and other objects, features and advantages of the present invention will be more apparent from the following detailed description taken in conjunction with the accompanying drawings, in which:

FIG. 1 is a perspective view of a conventional manual motor starter,

FIG. 2 is a perspective view of a handle apparatus for a conventional MMS in a state where the MMS is turned off;

FIG. 3 is a perspective view of a handle apparatus for a conventional MMS in a state where the MMS is turned on;

FIGS. 4A and 4B are perspective views of a handle apparatus for an MMS according to the present invention in a state where the MMS is turned off;

FIGS. 5A and 5B are perspective views of a handle apparatus for an MMS according to the present invention in a state where the MMS is turned on; and FIG. 6 is a perspective view of a driving lever and a control lever of an MMS according to the present invention.

DETAILED DESCRIPTION OF THE PREFERRED EMBODIMENTS

Hereinafter, a preferred embodiment of the present invention will be described with reference to the accompanying drawings.

FIGS. 4A and 4B are perspective views of a handle apparatus for an MMS according to the present invention in a state where the MMS is turned off, and FIGS. 5A and 5B are perspective views of a handle apparatus for an MMS according to the present invention in a state where the MMS is turned on. Further, FIG. 6 is a perspective view of a driving lever and a control lever of an MMS according to the present invention.

As shown in FIGS. 4 through 6, the handle apparatus for an MMS according to the present invention includes: a rotary handle 11 for controlling ON and OFF operations of the MMS; an interlocking member 12 coaxially coupled with the rotary handle 11 to be rotated by rotation of the rotary handle 11, the interlocking member 12 having a first gear 12*a* for providing a driving force; a driving lever 13 having a second gear 13*a* formed at one side of the driving lever 13 to be rotated by the driving force by the interlocking member 12, the driving lever 13 having a pin slot 13*b* for providing a rotational driving force; and a control lever 14 having a sliding pin 14*d* inserted in the pin slot 13*b* of the driving lever 13, through which the rotational driving force is transferred from the driving lever 13 to the control lever 14.

Referring to FIG. 6, the driving lever 13 also has a rotation shaft-holding boss 13*c* through which a rotation shaft for the driving lever 13 is inserted. The rotation shaft-holding boss 13*c* is integrally formed with a main body of the driving lever 13 and made from synthetic resin. Herein, the second gear 13*a* of the driving lever 13 and the first gear 12*a* of the interlocking member 12 are bevel gears meshed perpendicularly to each other. The driving lever 13 is rotated about a rotation shaft (not shown) inserted through the rotation shaft-holding boss 13*c* by the driving force of the interlocking member 12.

The control lever 14, as clearly shown in FIG. 6, is a U-shaped member including two opposing side plates and a connecting portion for interconnecting the two side plates. In the following description, the two side plates will be referred to as a first control lever body 14*a* and a second control lever body 14*b*. The first control lever body 14*a* has the sliding pin 14*d* inserted in the pin slot 13*b* of the driving lever 13, through which the rotational driving force is transferred from the driving lever 13 to the control lever 14. The sliding pin 14*d* is made from metal and especially has a slickly ground surface in order to minimize wearing of the driving lever 13 made from synthetic resin. The second control lever body 14*b* is apart a predetermined interval from the first control lever body 14*a*. A control lever rotation shaft 15 is fitted through lower portions of the first control lever body 14*a* and the second control lever body 14*b*. When the driving lever 13 is rotated, the rotation of the driving lever 13 is transferred through the circumference of the pin slot 13*b* to the sliding pin 14*d*, so that the control lever 14 is rotated a predetermined angle about the control lever rotation shaft 15. Specifically, when the rotary handle 11 is rotated 90° from the ON position to the OFF position and vice versa, the control lever 14 is rotated the predetermined angle of 47°.

In FIG. 6, reference numeral 14c not described above designates a spacing pin for spacing the first control lever body 14*a* and the second control lever body 14*b* of the control lever 14 a predetermined interval.

Hereinafter, on operation of a handle apparatus of an MMS having the aforementioned construction according to the present invention will be described. In order to turn on or off the MMS, a user may hold and rotate the rotary handle 11 between the ON position and the OFF position. Then, the rotary handle 11 rotates 90° clockwise or counterclockwise and the interlocking member 12 coaxially coupled with the rotary handle 11 also rotates 90° clockwise or counterclockwise. Then, the second gear 13*a* perpendicularly engaged with the first gear 12*a* of the interlocking member 12 rotates the driving lever 13 90° . The 90° rotation of the driving lever 13 is transferred to the sliding pin 14*d* by circumferential surfaces of the pin slot 13*b*, so that the control lever 14 rotates 47° about the control lever rotation shaft 15. Here, when the rotary handle 11 of the MMS is located at the OFF position, the sliding pin 14*d* of the control lever 14 is located at a lower position in the pin slot 13*b* of the driving lever 13 as shown in FIG. 4B. In contrast, when the rotary handle 11 of the MMS is located at the ON position, the sliding pin 14*d* of the control lever 14 is located at a middle position in the pin slot 13*b* of the driving lever 13 as shown in FIG. 5B.

As described above, in the handle apparatus according to the present invention, driving force is transferred by the sliding pin 14*d* of the control lever 14 made from metal, which is inserted through the pin slot 13*b* formed through the driving lever 13 made from synthetic resin. As a result, the present invention can solve the problem of the conventional MMS, in which the protuberance 3*b* of the driving lever 3 made from synthetic resin experience abrasion by circumferential surfaces of the crank hole 4*a* of the control lever 4 made from metal. Therefore, the present invention can improve the durability of the MMS and the reliability in operating the MMS.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A handle apparatus of a manual motor starter, the handle apparatus comprising:

a rotary handle that controls ON and OFF operations of the manual motor starter;

an interlocking member coaxially coupled with the rotary handle and configured to be rotated by rotation of the rotary handle, the interlocking member having a first gear for providing a driving force;

a driving lever having a second gear at one side of the driving lever and configured to be rotated by the driving force by the interlocking member, the driving lever having a pin slot for providing a rotational driving force, said driving lever comprising a synthetic resin; and a control lever having a sliding pin inserted in the pin slot of the driving lever, through which the rotational driving force is transferred from the driving lever to the control lever, said control lever and said sliding pin comprising metal.

2. The handle apparatus according to claim 1, wherein said first and second gears comprise bevel gears.

3. The handle apparatus according to claim 1, wherein, when said rotary handle is in an ON position, the sliding pin is located an at intermediate position of the pin slot and when the rotary handle is in and OFF position, the sliding pin is located adjacent an extremity of the pin slot.

4. A handle apparatus of a motor starter, the handle apparatus comprising:

a rotary handle mounted for movement between ON and OFF positions to control the ON and OFF operations of the motor starter;

an interlocking member coupled to said rotary handle and configured to be rotated in accordance with rotation of the rotary handle, the interlocking member having a first gear segment at a periphery of the interlocking member;

a driving lever having a second gear segment provided at a periphery of the driving lever, said second gear configured to receive motion from said first gear of said interlocking member, said driving lever having a pin slot, said pin slot rotating with said driving lever;

a control lever having a sliding pin extending substantially transverse to a surface of said control lever, said sliding pin being configured to be received in said pin slot of said driving lever, wherein a rotational driving force is transmitted from said driving lever to said control lever, said sliding pin being positioned at an intermediate location of said pin slot when said rotary handle is in the ON position and positioned adjacent an extremity of said pin slot when said rotary handle is in the OFF position.

5. The handle apparatus according to claim 4, wherein said driving lever comprises a synthetic resin material.

* * * * *

UNITED STATES PATENT AND TRADEMARK OFFICE

CERTIFICATE OF CORRECTION

PATENT NO. : 7,002,088 B2
APPLICATION NO. : 11/007310
DATED : February 21, 2006
INVENTOR(S) :Bong-Soo Shin It is certified that error appears in the above-identified patent and that said Letters Patent is hereby corrected as shown below:

At column 6, line 1 (claim 3, line 3) of the printed patent, “an at” should be --at an--.

At column 6, line 2 (claim 3, line 4) of the printed patent, “and” should be --an--.

Signed and Sealed this

Twelfth Day of December, 2006

JON W. DUDAS
*Director of the United States Patent and Trademark Office*